US009593878B2

(12) United States Patent
Celik et al.

(10) Patent No.: US 9,593,878 B2
(45) Date of Patent: Mar. 14, 2017

(54) COOLING DEVICE COMPRISING A HEIGHT ADJUSTABLE SHELF

(71) Applicant: ARCELIK ANONIM SIRKETI, Istanbul (TR)

(72) Inventors: Kadir Ridvan Celik, Istanbul (TR); Faik Emre Ozyuksel, Istanbul (TR); Mehmet Ercan Kaymak, Istanbul (TR); Turker Senturk, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

(21) Appl. No.: 14/758,215

(22) PCT Filed: Dec. 18, 2013

(86) PCT No.: PCT/EP2013/077120
§ 371 (c)(1),
(2) Date: Jun. 26, 2015

(87) PCT Pub. No.: WO2014/102114
PCT Pub. Date: Jul. 3, 2014

(65) Prior Publication Data

US 2015/0330700 A1 Nov. 19, 2015

(30) Foreign Application Priority Data

Dec. 26, 2012 (TR) ..... a 2012 15351

(51) Int. Cl.
*F25D 23/04* (2006.01)
*F25D 23/02* (2006.01)
*F25D 25/02* (2006.01)

(52) U.S. Cl.
CPC ..... *F25D 23/04* (2013.01); *F25D 23/028* (2013.01); *F25D 25/02* (2013.01)

(58) Field of Classification Search
CPC ..... F25D 23/02; F25D 23/028; F25D 23/04; F25D 2325/00; F25D 25/02; F25D 25/022;
(Continued)

(56) References Cited

U.S. PATENT DOCUMENTS 1,257,998 A * 3/1918 Gruber ..... E05C 1/14 292/170
3,096,885 A * 7/1963 Peters ..... F25D 25/027 248/240
(Continued)

FOREIGN PATENT DOCUMENTS

DE 102008014885 A1 9/2009
DE 102009046614 A1 * 5/2011 ..... F25D 23/04
(Continued)

OTHER PUBLICATIONS

International Search Report and Written Opinion for WO2014/102114 A1 & References Cited Therein.

*Primary Examiner* — Andrew Roersma
(74) *Attorney, Agent, or Firm* — Kilpatrick Townsend & Stockton LLP

(57) ABSTRACT

The present invention relates to a cooling device (1) comprising a door (2), more than one support member (3) disposed on the inner surface of the door (2), arranged one below the other and spaced apart along the vertical direction (Y), a height adjustable shelf (4) mounted on the support members (3), a locking mechanism (5) disposed on the shelf (4), having a first position (P1) wherein the locking mechanism (5) enables the height of the shelf (4) to be fixed by interacting with the support member (3) and a second position (P2) wherein the locking mechanism (5) dislodges from the support member (3), enabling the shelf (4) to move on the support members (3) in the vertical direction (Y).

18 Claims, 4 Drawing Sheets

Figure 1:
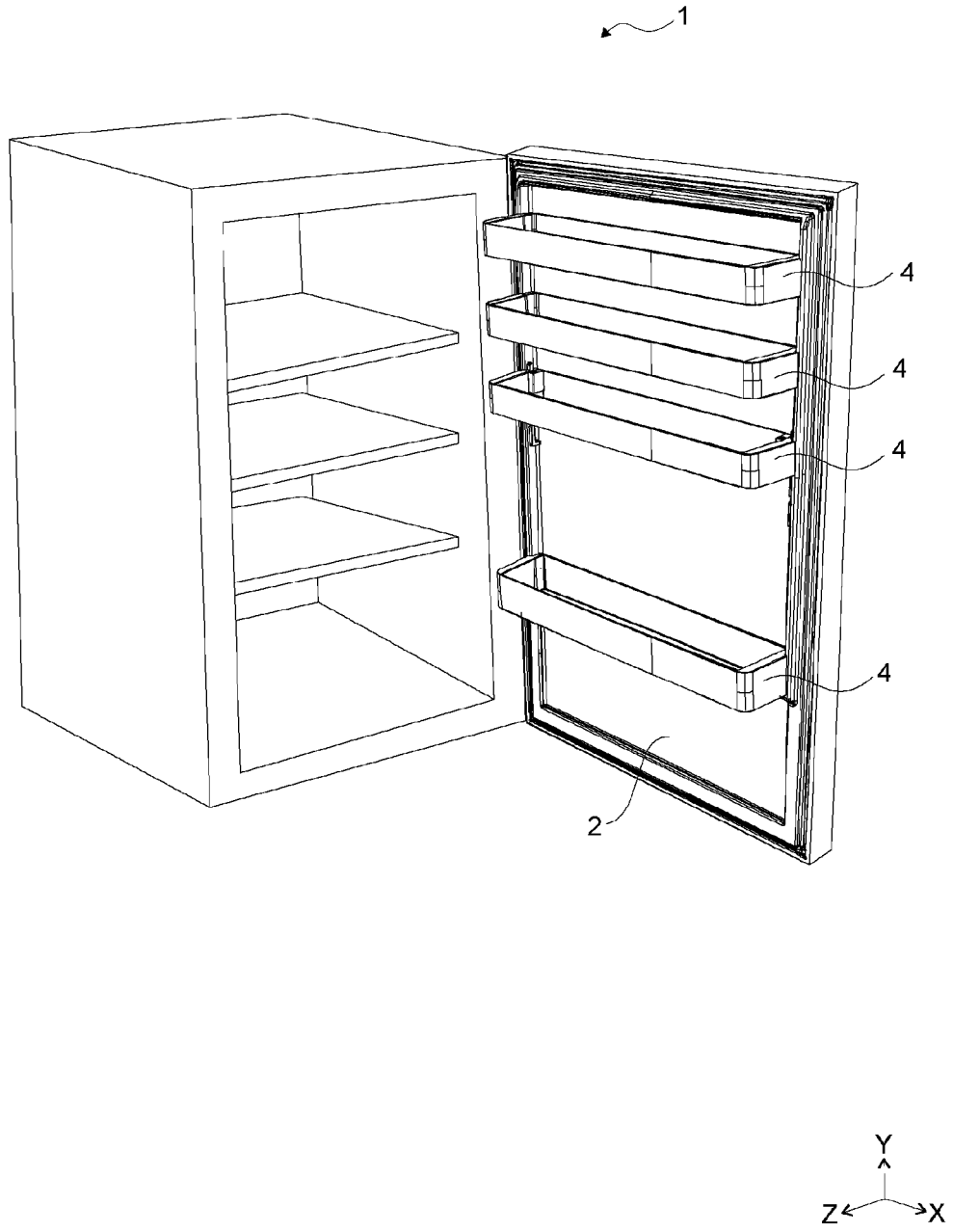

(58) Field of Classification Search
CPC ..... F25D 25/024; A47B 57/06; A47B 57/08; A47B 57/10; A47B 57/12; A47B 57/14; A47B 57/16; A47B 57/20; A47B 57/48; A47B 57/482; A47B 57/485; A47B 57/487
See application file for complete search history.

(56) References Cited

U.S. PATENT DOCUMENTS

| | | | | |
|---|---|---|---|---|
| 3,610,174 | A | 10/1971 | Kesling | |
| 2005/0062380 | A1* | 3/2005 | Park | A47B 57/06 312/408 |
| 2010/0060124 | A1* | 3/2010 | Kang | F25D 25/04 312/408 |
| 2010/0060125 | A1* | 3/2010 | Kang | A47B 57/06 312/408 |

FOREIGN PATENT DOCUMENTS

| | | | | |
|---|---|---|---|---|
| DE | EP 2354732 | A2 * | 8/2011 | F25D 23/04 |
| DE | WO 2014166868 | A1 * | 10/2014 | F25D 23/04 |
| EP | 2498031 | A1 | 9/2012 | |
| KR | 20120009651 | A | 2/2012 | |
| TR | WO 2010076205 | A1 * | 7/2010 | F25D 23/04 |
| TR | EP 2405217 | A2 * | 1/2012 | F25D 23/04 |
| WO | 2008077740 | A2 | 7/2008 | |
| WO | 2009/115133 | A1 | 9/2009 | |
| WO | 2012120045 | A2 | 9/2012 | |

* cited by examiner

P1

P2

COOLING DEVICE COMPRISING A HEIGHT ADJUSTABLE SHELF

The present invention relates to a cooling device comprising a height adjustable shelf.

In refrigerators, at the inner side of the door shelves are used whereon food and beverage containers are disposed. While placing high containers on the shelf, one or more shelves above this shelf are required to be dislodged or changed places. The shelves have to be entirely unloaded in order to perform these operations in a safe manner. This not only makes utilization difficult but also results in loss of time. When low containers are placed on the shelf, unused dead spaces remain between the said containers and the shelf above. In order to solve the said problem, shelves, the height of which can be adjusted without being taken off the door, are utilized. In these shelf mechanisms that are actuated by means of a button, the shelf may come off from the hand of the user and fall while pressing on the button. Furthermore, since the button is disposed on the outer surface of the shelf, the user can accidentally touch the button and cause the shelf to be damaged by being dislodged.

In the state of the art International Patent Application No. WO2012120045, a cooling device comprising a height adjustable door shelf is described. In this embodiment, the door shelf is dislodged by pressing on a coupling means located at its lower side and is slid on the lugs situated on the door. When the shelf is brought to the desired height, the coupling means is released and the shelf is provided to be fixed at that level. Being situated at the lower side of the shelf, the coupling means cannot be seen by the user and can be actuated by hand.

In the state of the art International Patent Application No. WO2008077740, a cooling device comprising a height adjustable door shelf is described. In this embodiment, the shelf is controlled by means of a button situated on its side wall. The shelf is provided to be fixed at different levels by fitting the protrusions disposed on both sides of the shelf to the recesses located on the door.

The aim of the present invention is the realization of a cooling device which comprises a shelf disposed on the door, the position of which can be changed easily by being moved in the vertical direction.

The cooling device realized in order to attain the aim of the present invention, explicated in the first claim and the respective claims thereof comprises a height adjustable shelf situated on its door. The locking mechanism disposed on the shelf is coupled with the support member on the door and the shelf is provided to be attached to the door. The locking mechanism is moved between two positions by means of a button. The locking mechanism that is locked with the support member in the first position, is released from the support member in the second position. The shelf is in the locked mode wherein the height thereof is fixed while the locking mechanism is in the first position. The shelf is in the free mode wherein the height thereof can be changed while the locking mechanism is in the second position. The button enabling the position of the shelf to be adjusted moves in the vertical direction just like the shelf. During the movement of the shelf, the shelf can be held firmly while pressing on the button due to the position the user holds her/his hand.

In an embodiment of the present invention the support members are positioned along the opposite lateral sides of the door. The protrusion-shaped support members are in form of a rectangle with rounded corners, extending longitudinally along the long side of the door.

In an embodiment of the present invention, the locking mechanism comprises a cam element that rotates around an axis and a rib connected to the cam element. The rib, changing position together with the cam element, enables the shelf to shift from the free mode to the locked mode and from the locked mode to the free mode. In this embodiment, the rib is the part of the locking element contacting the support member. When the locking mechanism is in the first position, the rib is seated on the side of the support member facing upwards and when the locking mechanism is in the second position, the rib becomes almost parallel to the support member.

In a version of this embodiment, the cam element is configured as a ring and the rib as an arc segment that extends outwards from the quarter portion of the ring. In this embodiment, the cam element makes a 90 degrees rotational movement while the locking mechanism is changed between the first position and the second position.

In an embodiment of the present invention, the locking mechanism comprises a first gear extending downwards from the lower surface of the button and a second gear that extends outwards from the rear surface of the cam element. The type of movement can be changed easily by means of the first gear being flat and the second gear being circular.

In an embodiment of the present invention, the cooling device comprises guides disposed on the lateral sides of the shelf and which enable the shelf to be slidingly mounted on the support member. The guide enables the shelf to be borne on the door and also prevents the forwards-backwards movement of the shelf.

In a version of this embodiment, the guide is composed of two pieces and the cam element is disposed between the two guide pieces. In this embodiment, the distance between the guide pieces is smaller than the height of the support member. Thus, the shelf is prevented from dislodging from the door during the height changing process.

In an embodiment of the present invention, the locking mechanism comprises a prestress means that brings the button to its free position after the pressure applied on the button is removed. Thus, when the shelf is brought to the desired height, the necessity for performing an additional operation is not required for fixing the height of the shelf and the shelf is changed from the free mode to the locked mode by the button returning to its initial position automatically.

In an embodiment of the present invention, the button is disposed at the inner side of the shelf side wall, accessible from the upper side of the shelf and is actuated from the top downwards. In this embodiment, the user, while pressing on the button with the thumb, holds the shelf from below with the other fingers and changes the mode of the shelf safely.

In an embodiment of the present invention the distance between two consecutive support members is less than the height of the shelf. Thus, the shelf is prevented from dislodging from the support members.

In an embodiment of the present invention, the cooling device comprises a stopper that extends vertically to the lowermost upright member and prevents dislodgement of the shelf from the door. Consequently, the height of the shelf can be changed in a safe manner without the risk of falling.

In an embodiment of the present invention, the shelf is disposed between two upright members situated on the sides of the door. The shelf is prevented from moving in the horizontal direction by means of the upright members supporting the shelf from the lateral sides.

In an embodiment of the present invention, a locking mechanism is disposed on each side wall of the shelf. Thus, the shelf can be synchronically moved from two sides.

In an embodiment of the present invention, the support members are arranged along the long side of the door.

By means of the present invention, the heights of the shelves disposed on the door can be changed while the shelf is still mounted on the door. By means of the button which enables the user to start the height changing operation by being actuated in the vertical direction, the shelf can be held easily and height changing operation can be performed safely.

The cooling device realized in order to attain the aim of the present invention is illustrated in the attached figures, where:

FIG. 1—is the perspective view of a cooling device, the door of which is open.

Figure 2:
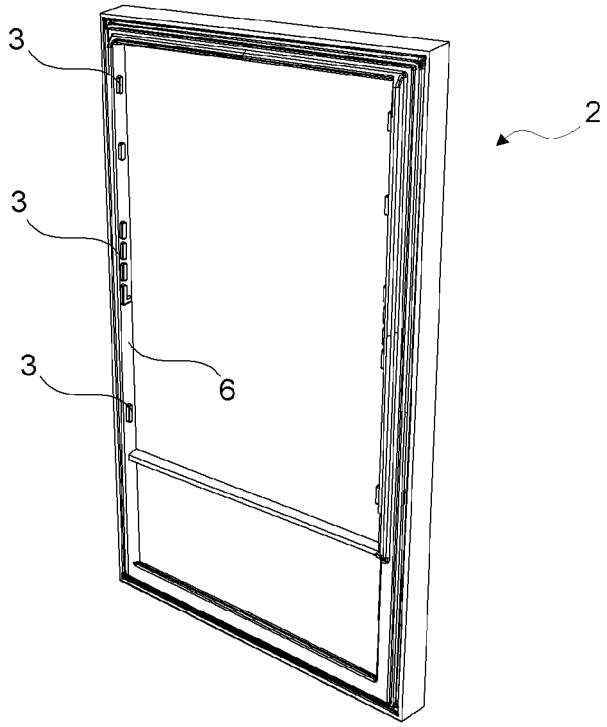

FIG. 2—is the perspective view of the door.

Figure 3:
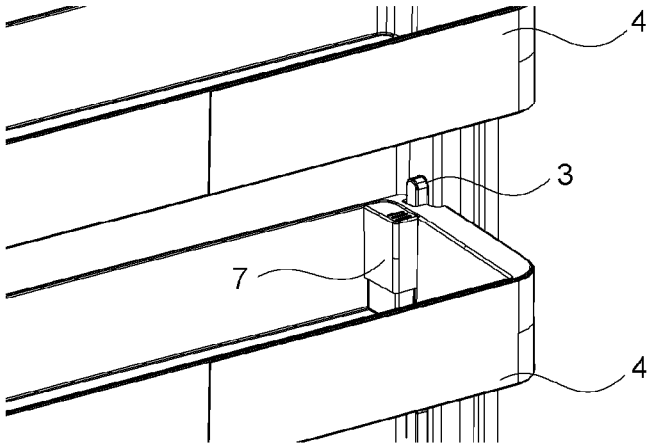

FIG. 3—is the partial view of the shelf, the button and the support member.

Figure 4:
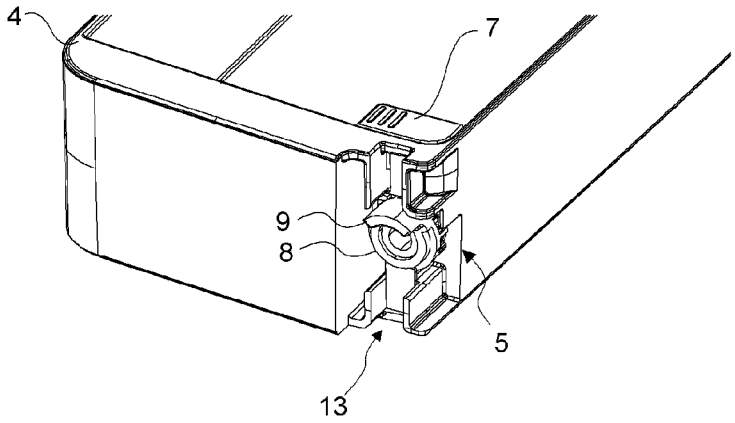

FIG. 4—is the perspective view of the locking mechanism, the guide and the shelf.

Figure 5:
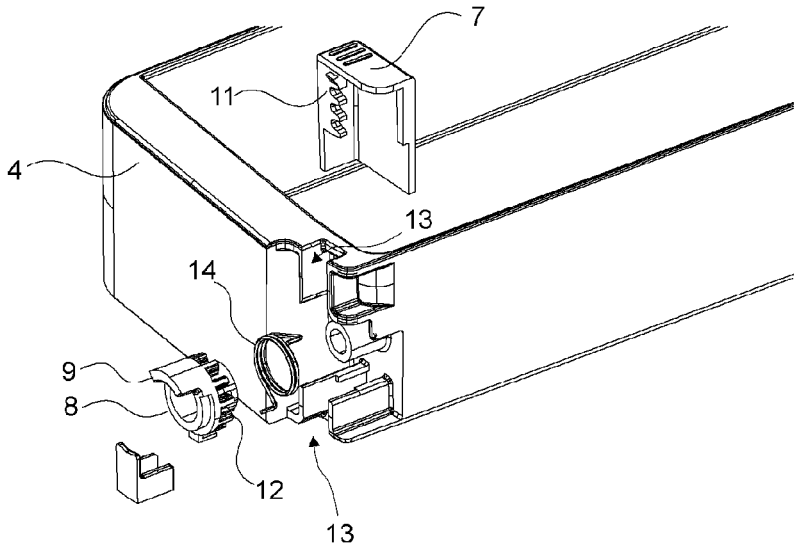

FIG. 5—is the exploded view of the locking mechanism, the guide and the shelf.

Figure 6:
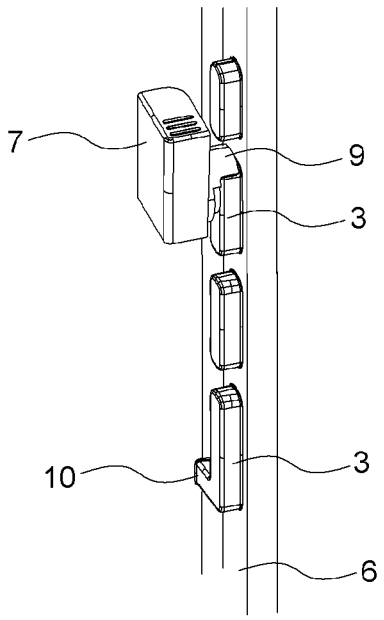

FIG. 6—is the perspective view of the support member, the button, the cam element and the rib while the locking mechanism is in the first position.

Figure 7:
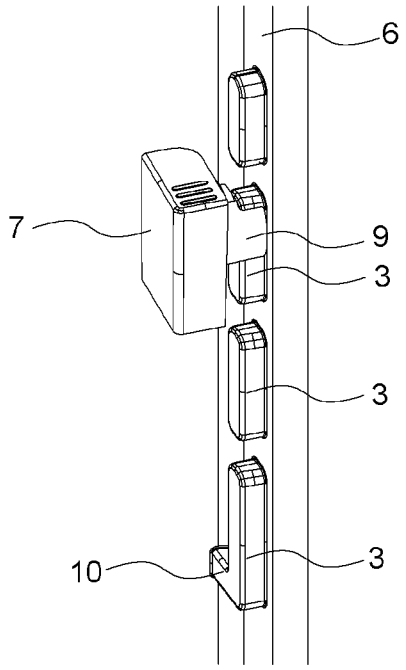

FIG. 7—is the perspective view of the support member, the button, the cam element and the rib while the locking mechanism is in the second position.

Figure 8:
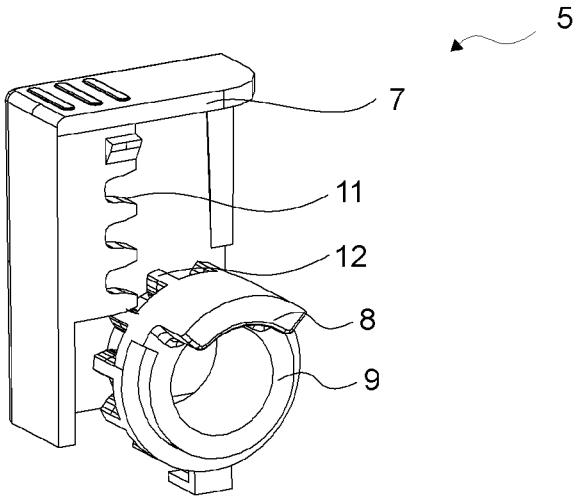

FIG. 8—is the perspective view of the locking mechanism.

The elements illustrated in the figures are numbered as follows:

1. Cooling device
2. Door
3. Support member
4. Shelf
5. Locking mechanism
6. Upright member
7. Button
8. Cam element
9. Rib
10. Stopper
11. First gear
12. Second gear
13. Guide
14. Prestress means The cooling device (1) comprises a door (2), more than one support member (3) disposed on the inner surface of the door (2), arranged one below the other and spaced apart along the vertical direction (Y), a height adjustable shelf (4) mounted on the support members (3) and a locking mechanism (5) disposed on the shelf (4), having a first position (P1) wherein the locking mechanism (5) enables the height of the shelf (4) to be fixed by interacting with the support member (3) and a second position (P2) wherein the locking mechanism (5) dislodges from the support member (3), enabling the shelf (4) to move on the support members (3) in the vertical direction (Y).

The shelf (4) is stationary while the locking mechanism (5) is in the first position (P1). When the locking mechanism (5) is brought to the second position (P2), the shelf (4) can be moved in the vertical direction (Y) since there is no longer any element supporting the shelf (4) in the vertical direction (Y). The passage of the locking mechanism (5) between the first position (P1) and the second position (P2) is controlled by the user (FIG. 1, FIG. 2).

In the cooling device (1) of the present invention, the locking mechanism (5) comprises a button (7) that is actuated in the vertical direction (Y) and that enables the locking mechanism (5) to be changed from the first position (P1) to the second position (P2) when the height of the shelf (4) is desired to be changed. By means of the button (7) being moved in the vertical direction (Y), the user is enabled to clasp the shelf (4) with all fingers by holding from the upper and lower sides and the height of the shelf (4) is provided to be changed safely (FIG. 3, FIG. 4, FIG. 5).

In this embodiment, the button (7) moves in the same direction as the movement direction of the shelf (4). Thus, the finger used for actuating the button (7) is also used in carrying the load of the shelf (4) actively.

The shelf (4) has a locked mode (L) when the button (7) is free and a free mode (F) when the button (7) is pressed on. In this embodiment, as long as the button (7) is kept pressed on, the locking mechanism (5) stays in the second position (P2). Meanwhile, the shelf (4) can be moved in the vertical direction (Y). When the button (7) is released, if the locking mechanism (5) is at the level of the gap between the support members (3), the locking mechanism (5) enables the shelf (4) to be seated on the support member (3) by changing to the first position (P1). When the button (7) is released, if the locking mechanism (5) is at the level of the support member (3), the locking mechanism (5) continues its movement in the intermediate position up to the gap between the support members (3) and changes to the first position (P1) upon reaching the gap between the support members (3).

In an embodiment of the present invention, the support members (3) extend as two rows parallel to each other at the portions close to the long sides of the door (2). In this embodiment, the support member (3) is in form of a protrusion and its cross-section is oblong. The support members (3) support the shelf (4) from two sides. The shelf (4) is easily seated on the support member (3) by means of the support members (3) being protrusion-shaped. The shelf (4) can be slid easily on the support members (3) by means of their oblong shapes. When in the first position (P1), the locking mechanism (5) is seated on the arc-shaped upper portion of the support member (3) (FIG. 2, FIG. 6, FIG. 7).

In an embodiment of the present invention, the locking mechanism (5) comprises a cam element (8) that is rotatably mounted on the shelf (4) and a rib (9) extending outwards from the cam element (8), moving together with the cam element (8), seated on the support member (3) in the first position (P1), and enabling the shelf (4) to move by being separated from the support member (3) in the second position (P2). When the shelf (4) is in the locked mode (L), the rib (9) is seated on the support member (3). The rib (9) is seated on the support member (3) firmly since the inner surface of the rib (9) and the upper side of the support member (3) have the same form. When the button (7) is actuated, the rib (9) is separated from the support member (3) by rotating together with the cam element (8) and enables the shelf (4) to move (FIG. 4, FIG. 5, FIG. 6, FIG. 7, FIG. 8).

In a version of this embodiment, the cam element (8) is configured as a ring. In this embodiment, the rib (9) is an arc segment, extending along almost a quarter portion of the cam element (8). Since the rib (9) is in the same shape as the upper part of the support member (3), when the locking mechanism (5) is in the first position (P1), the rib (9) is seated on the support member (3) without any gap therebetween and enables the shelf (4) to remain firmly on the door (2). When the shelf (4) is desired to be changed to the free mode (F), the button (7) is actuated and the cam element (8) is rotated with almost a 90 degree angle. During this movement, the rib (9) detaches from over the support member (3) and becomes parallel to the support member (3). Thus, the rib (9) does not impact the support members (3) during the movement of the shelf (4) and does not obstruct the movement of the shelf (4) (FIG. 4, FIG. 5, FIG. 8).

In an embodiment of the present invention, the locking mechanism (5) comprises a first gear (11) extending downwards from the lower surface of the button (7) and that enables the translatory movement of the button (7) to be transmitted as rotational movement to the cam element (8), and a second gear (12) situated on the cam element (8) and connected functionally to the first gear (11). The first gear (11), being directly connected to the button (7), moves together with the button (7) in the linear direction when the button (7) is actuated. The second gear (12), making rotational movement around the axis whereto it is connected, rotates due to its contact with the first gear (11) and also rotates the cam element (8) whereto it is connected directly. Consequently, the movement of the button (7) is transmitted to the cam element (8) easily and effectively (FIG. 5, FIG. 8).

In an embodiment of the present invention, the cooling device (1) comprises a guide (13) that enables the shelf (4) to be slidingly mounted on the support member (3) and prevents dislodgement of the shelf (4) from the support member (3) by limiting the movement thereof in the horizontal plane. In this embodiment, the guide (13) is configured as a channel wherein the support members (3) are disposed. While the support members (3) are seated into the guide (13), the guide (13) moves over the support members (3). By means of the guide (13), the shelf (4) is prevented from moving forward and being dislodged. Furthermore, the shelf (4) is provided to move in a linear path (FIG. 4, FIG. 5).

In a version of this embodiment, the guide (13) is composed of two pieces, one being below and the other above the cam element (8). Thus, the guide (13) can be disposed on the lateral sides of the shelf (4) without obstructing the cam element (8) (FIG. 4, FIG. 5).

In a version of this embodiment, the height of the support member (3) is more than the distance between the pieces of the guide (13) under and above the cam element (8). Thus, during the height changing process, the shelf (4) is prevented from dislodging by being separated from the support members (3).

In an embodiment of the present invention, the locking mechanism (5) comprises a prestress means (14) that enables the shelf (4) to change to the locked mode (L) by bringing the button (7) to the initial position when the button (7) is released while the shelf (4) is in the free mode (F). Thus, after the shelf (4) is brought to the desired level, releasing the button (7) is sufficient for fixing the shelf (4) at that level. This provides ease of utilization (FIG. 5).

In an embodiment of the present invention, the button (7) is positioned at the inner side of the shelf (4) so as to be accessible from the upper surface of the shelf (4) and is actuated by being pressed from top downwards. In this embodiment, the user, while actuating the button (7) with the thumb, can grasp the shelf (4) from below with the other fingers. Consequently, the shelf (4) can be easily moved without removing the items on the shelf (4). Furthermore, since both of the buttons (7) are in a position visible from outside, problems like accidental actuation of the button (7) are eliminated (FIG. 3, FIG. 4, FIG. 5).

In an embodiment of the present invention the distance between the two adjacent support members (3) is less than the height of the shelf (4). Thus, the shelf (4) is prevented from dislodging from the support members (3).

In an embodiment of the present invention, the cooling device (1) comprises a stopper (10) that extends sideways and vertically up from the lower end of the lowermost support member (3) and that prevents dislodgement of the shelf (4) from the door (2). Thus, the height of the shelf (4) can be changed in a safe manner without the risk of falling.

In an embodiment of the present invention, the cooling device (1) comprises two opposite upright members (6) disposed at the portions of the door (2) close to the lateral sides, extending outwards from the inner surface of the door (2) and the support members (3) positioned on the upright members (6) so as to face one another. In this embodiment, the distance between the upright members (6) is almost the same as the width of the shelf (4). Consequently, the shelf (4) seated on the support members (3) is supported from both sides by means of the upright members (6) and is prevented from moving in the horizontal direction (FIG. 2).

In an embodiment of the present invention, a locking mechanism (5) is disposed on each side of the shelf (4).

In an embodiment of the present invention, the support members (3) are arranged along the door (2). Thus, the heights of the shelves (4) can be adjusted flexibly.

By means of the present invention, the heights of the shelves (4) disposed on the door (2) can be changed while the shelf (4) is still mounted on the door (2) without removing the items thereon. The shelf (4) can be held easily and the height changing operation can be performed safely by means of the button (7) which enables the user to start the height changing operation by being actuated in the vertical direction (Y). The problems like the shelf (4) moving in the horizontal and dislodging from the door (2) are eliminated by means of the support members (3) and the height of the shelf (4) can be changed safely.

The invention claimed is:

1. A cooling device (1) comprising a door (2), more than one support member (3) disposed on an inner surface of the door (2), arranged one below another and spaced apart along a vertical direction (Y), a height adjustable shelf (4) mounted on the support members (3) and a locking mechanism (5) disposed on the shelf (4) and comprising a cam element (8) that is rotatably mounted on the shelf (4), the locking mechanism having a first position (P1) wherein the locking mechanism (5) enables a height of the shelf (4) to be fixed by interacting with the support member (3) and a second position (P2) wherein the locking mechanism (5) dislodges from the support member (3), enabling the shelf (4) to move on the support members (3) in the vertical direction (Y), wherein the locking mechanism (5) has a button (7) that is actuated in the vertical direction (Y), enabling the locking mechanism (5) to be changed from the first position (P1) to the second position (P2) when the height of the shelf (4) is desired to be changed wherein the locking mechanism comprises a first gear (11) extending downwards from a lower surface of the button (7) and that enables a translatory movement of the button (7) to be transmitted as rotational movement to the cam element (8) and a second gear (12) situated on the cam element (8) and connected functionally to the first gear (11).

2. The cooling device (1) as in claim 1, wherein the button (7) moves in a same direction as the shelf (4).

3. The cooling device (1) as in claim 1, wherein the shelf (4) has a locked mode (L) when the button (7) is in a free position and a free mode (F) when the button (7) is pressed on.

4. The cooling device (1) as in claim 1, wherein the support members (3) are configured as protrusions with oblong cross sections, that extend as two rows parallel to each other along portions close to long sides of the door (2).

5. The cooling device (1) as in claim 1, wherein the locking mechanism (5) comprises a rib (9) having an arc shape extending outwards from the cam element (8), moving together with the cam element (8), seated on the support member (3) in the first position (P1), and enabling the shelf (4) to move by being separated from the support member (3) in the second position (P2).

6. The cooling device (1) as in claim 5, wherein the cam element (8) has a ring shape and the rib (9) extends along almost a quarter portion of the cam element (8).

7. The cooling device (1) as in claim 1, further comprising a guide (13) that enables the shelf (4) to be slidingly mounted on the support member (3) and prevents dislodgement of the shelf (4) from the support member (3) by limiting movement in a horizontal plane.

8. The cooling device (1) as in claim 7, wherein the guide (13) is composed of two pieces, one being below and another being above the cam element (8).

9. The cooling device (1) as in claim 8, wherein a height of the support member (3) is greater than a distance between pieces of the guide (13) under and above the cam element (8).

10. The cooling device (1) as in claim 1, wherein the locking mechanism (5) comprises a prestress means (14) that enables the shelf (4) to change to the locked mode (L) by bringing the button (7) to an initial position when the button (7) is released while the shelf (4) is in the free mode (F).

11. The cooling device (1) as in claim 1, wherein the button (7) is positioned at an inner side of the shelf (4) so as to be accessible from an upper surface of the shelf (4) and is actuated by being pressed from top downwards.

12. The cooling device (1) as in claim 1, further comprising two consecutive support members (3), a distance therebetween being less than the height of the shelf (4).

13. The cooling device (1) as in claim 1, further comprising a stopper (10) that extends sideways and vertically upwards from a lower end of a lowermost portion of the support member (3) and prevents dislodgement of the shelf (4) from the door (2).

14. The cooling device (1) as in claim 1, further comprising two opposite upright members (6) disposed along portions of the door (2) close to lateral sides of the door (2), extending outwards from the inner surface of the door (2) and by the support members (3) positioned on the upright members (6) so as to face one another.

15. A cooling device (1) comprising a door (2), more than one support member (3) disposed on an inner surface of the door (2), arranged one below another and spaced apart along a vertical direction (Y), a height adjustable shelf (4) mounted on the support members (3) and a locking mechanism (5) disposed on the shelf (4), having a first position (P1) wherein the locking mechanism (5) enables a height of the shelf (4) to be fixed by interacting with the support member (3) and a second position (P2) wherein the locking mechanism (5) dislodges from the support member (3), enabling the shelf (4) to move on the support members (3) in the vertical direction (Y), wherein the locking mechanism (5) has a button (7) that is actuated in the vertical direction (Y), enabling the locking mechanism (5) to be changed from the first position (P1) to the second position (P2) when the height of the shelf (4) is desired to be changed, wherein the button (7) moves in a same direction as the shelf (4), wherein the shelf (4) has a locked mode (L) when the locking mechanism is in the first position and the button (7) is in a free position and a free mode (F) when the button (7) is pressed on and the locking mechanism is in the second position, and wherein the support members (3) are configured as protrusions with oblong cross sections, that extend as two rows parallel to each other along portions close to long sides of the door (2), wherein the locking mechanism (5) comprises a cam element (8) that is rotatably mounted on the shelf (4) and a rib (9) extending outwards from the cam element (8), moving together with the cam element (8), seated on the support member (3) in the first position (P1), and enabling the shelf (4) to move by being separated from the support member (3) in the second position (P2), wherein the cam element (8) has a ring shape and the rib (9) has a segment shape extending along almost a quarter portion of the cam element (8), wherein the locking mechanism (5) comprises a first gear (11) extending downwards from a lower surface of the button (7) and that enables a translatory movement of the button (7) to be transmitted as rotational movement to the cam element (8) and a second gear (12) situated on the cam element (8) and connected functionally to the first gear (11), and further comprising a guide (13) that enables the shelf (4) to be slidingly mounted on the support member (3) and prevents dislodgement of the shelf (4) from the support member (3) by limiting movement in a horizontal plane, wherein the guide (13) is composed of two pieces, one being below and another being above the cam element (8), wherein a height of the support member (3) is greater than a distance between the pieces of the guide (13) below and above the cam element (8), and wherein the locking mechanism (5) comprises a prestress means (14) that enables the shelf (4) to change to the locked mode (L) by bringing the button (7) to the free position when the button (7) is released while the shelf (4) is in the free mode (F), and wherein the button (7) is positioned at an inner side of the shelf (4) so as to be accessible from an upper surface of the shelf (4) and that is actuated by being pressed from top downwards.

16. The cooling device (1) as in claim 15, further comprising two consecutive support members (3), a distance therebetween being less than the height of the shelf (4).

17. The cooling device (1) as in claim 16, further comprising a stopper (10) that extends sideways and vertically upwards from a lower end of a lowermost portion of the support member (3) and that prevents dislodgement of the shelf (4) from the door (2).

18. The cooling device (1) as in claim 17, further comprising two opposite upright members (6) disposed along portions of the door (2) close to lateral sides of the door (2), extending outwards from the inner surface of the door (2) and the support members (3) positioned on the upright members (6) so as to face one another.

* * * * *